US007320579B2

(12) United States Patent
Hirano et al.

(10) Patent No.: US 7,320,579 B2
(45) Date of Patent: Jan. 22, 2008

(54) ROOTS TYPE FLUID MACHINE

(75) Inventors: Takayuki Hirano, Kariya (JP); Kazuho Yamada, Kariya (JP); Toshiro Fujii, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 0 days.

(21) Appl. No.: 11/608,615

(22) Filed: Dec. 8, 2006

(65) Prior Publication Data

US 2007/0148030 A1 Jun. 28, 2007

(30) Foreign Application Priority Data

Dec. 9, 2005 (JP) ..... 2005-355957

(51) Int. Cl.
*F01C 21/10* (2006.01)
*F03C 2/00* (2006.01)
*F04C 2/00* (2006.01)

(52) U.S. Cl. ..... 418/150; 418/206.1; 418/206.5

(58) Field of Classification Search ..... 418/150, 418/206.1, 206.5
See application file for complete search history.

(56) References Cited

U.S. PATENT DOCUMENTS

| | | | | |
|---|---|---|---|---|
| 1,442,018 | A * | 1/1923 | Jansen | 418/150 |
| 3,089,638 | A * | 5/1963 | Rose | 418/150 |
| 3,275,225 | A * | 9/1966 | Schultz | 418/150 |
| 4,455,132 | A * | 6/1984 | Messori | 418/206.5 |
| 4,943,214 | A * | 7/1990 | Niimura et al. | 418/150 |

FOREIGN PATENT DOCUMENTS

| | | | |
|---|---|---|---|
| JP | 01077782 | A * | 3/1989 |
| JP | 9-246277 | | 10/1997 |

* cited by examiner

*Primary Examiner*—Theresa Trieu
(74) *Attorney, Agent, or Firm*—Woodcock Washburn LLP

(57) ABSTRACT

A roots type fluid machine includes a housing, a pair of parallel rotary shafts and two-lobe rotors. Each rotor includes two lobe portions and two well portions. Each lobe portion has a profile of convex arc with a radius R and each well portion has a profile of concave arc which is an envelope of the convex arc of the lobe portion. The rotor has a configuration defined by a curve which includes the convex arc, the concave arc and further an involute curve with a base radius r between the convex and concave arcs. The base radius r is set in a range $L/(2\sqrt{2})<r<0.3(\sqrt{2})L$ where distance between axes of the rotary shafts is L, and the radius R is set in a range $\{(\sqrt{2})/16\}\pi L<R<\{(27-5\sqrt{2})/56\}L$.

10 Claims, 3 Drawing Sheets

ROOTS TYPE FLUID MACHINE

CROSS-REFERENCE TO RELATED APPLICATION

This application claims priority to Japanese Patent Application No. 2005-355957 filed Dec. 9, 2006.

BACKGROUND OF THE INVENTION

The present invention relates to a roots type fluid machine wherein a pair of parallel rotary shafts is rotatably supported by a housing and each rotary shaft has disposed thereon a rotor which has at least two lobe portions and two well portions so that the rotors engage with each other, and each rotor is located in a rotor chamber of the housing.

A roots compressor that serves as a roots type fluid machine has a housing and a pair of two-lobe or three-lobe rotors located in a rotor chamber of the housing. The rotors are located in the rotor chamber so as to have minimum clearance with the peripheral surface of the rotor chamber and also between the rotors. The two-lobe rotors engage with each other every 90 degrees of rotation of the rotors and the three-lobe rotors every 60 degrees of rotation of the rotors. There is an involute type rotor a part of which is formed by an involute curve. The involute type rotor is formed so that its lobe portion tapers toward its tooth tip. Therefore, the involute type rotor of the roots compressor has a small moment of inertia and, therefore, the roots compressor can be rotated at a high speed. In addition, a large volume of fluid can be trapped between the rotors and the peripheral surface of the rotor chamber, so that the displacement per rotation of the rotor is increased, thus offering an improved compression performance.

Since the tooth tip of the lobe portion of the involute type rotor is thin and a recess is formed in the well portion of the rotor for preventing interference with the lobe portion, the engaged rotors have formed between the lobe portion and the well portion thereof a space. The fluid or gas trapped in the space is compressed, expands and then released to the rotor chamber in accordance with rotation of the rotor. When the fluid is released to the rotor chamber, a large noise is generated.

Japanese Unexamined Patent Application Publication No. 9-264277 discloses a roots compressor or a roots type fluid machine having rotors which permit trapping of a large volume of fluid while preventing the abnormal noise. In the roots compressor of the cited reference, the lobe portion and the well portion of the rotor are formed in the shape of a circular arc and the other part of the rotor is formed by an involute curve. By so forming the rotor, trapping of a large volume of fluid is ensured and a space is prevented from being formed between the lobe portion and the well portion and, therefore, the noise generation is prevented.

In prior art roots compressors including the above-described roots compressor, a phase shift may occur when the rotor is tilted by a load received by the rotor during operation of the compressor, or a phase shift may be caused also during assembling of the compressor. In the roots compressor having such a phase shift, the lobe portion of one rotor and the well portion of the other rotor interfere with each other, which causes trouble such as noise. To eliminate the trouble, a large clearance needs be set between the rotors of the roots compressor in view of the above phase shift. If a large clearance is provided, however, leak of the fluid through the clearance will be increased thereby to reduce the performance of the roots compressor. For this reason, when the high performance of the roots compressor is desired, the clearance must be small, which makes it hard to avoid the interference between the rotors due to the phase shift. Therefore, it is desired to provide a roots compressor which is capable of preventing a trouble caused by interference between the rotors due to the phase shift.

The present invention is directed to a roots type fluid machine which prevents a trouble caused by the interference between the rotors due to the phase shift while ensuring trapping of a large volume of fluid.

SUMMARY OF THE INVENTION

In accordance with a first aspect of the present invention, a roots type fluid machine includes a housing, a pair of parallel rotary shafts rotatably supported by the housing and a two-lobe rotor disposed on each rotary shaft in a rotor chamber of the housing so that the rotors engage with each other. Each of the rotors includes two lobe portions and two well portions. Each lobe portion has a profile of convex arc with a radius R and each well portion has a profile of concave arc which is an envelope of the convex arc of the lobe portion. The rotor has a configuration defined by a curve which includes the convex arc, the concave arc and further an involute curve with a base radius r between the convex and concave arcs. The base radius r is set in a range $L/(2\sqrt{2})<r<0.3(\sqrt{2})L$ where distance between axes of the rotary shafts is L, and the radius R is set in a range $\{(\sqrt{2})/16\}\pi L<R<\{(27-5\sqrt{2})/56\}L$.

In accordance with a second aspect of the present invention, a roots type fluid machine includes a housing, a pair of parallel rotary shafts rotatably supported by the housing and a three-lobe rotor disposed on each rotary shaft in a rotor chamber of the housing so that the rotors engage with each other. Each of the rotors includes three lobe portions and three well portions. Each lobe portion has a profile of convex arc with a radius R and each well portion has a profile of concave arc which is an envelope of the convex arc of the lobe portion. The rotor has a configuration defined by a curve which includes the convex arc, the concave arc and further an involute curve with a base radius r between the convex and concave arcs. The base radius r is set in a range $L/(2\sqrt{2})<r<1.35L$ where distance between axes of the rotary shafts is L, and the radius R is set in a range $\pi/(12\sqrt{2})L<R<0.25L$.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
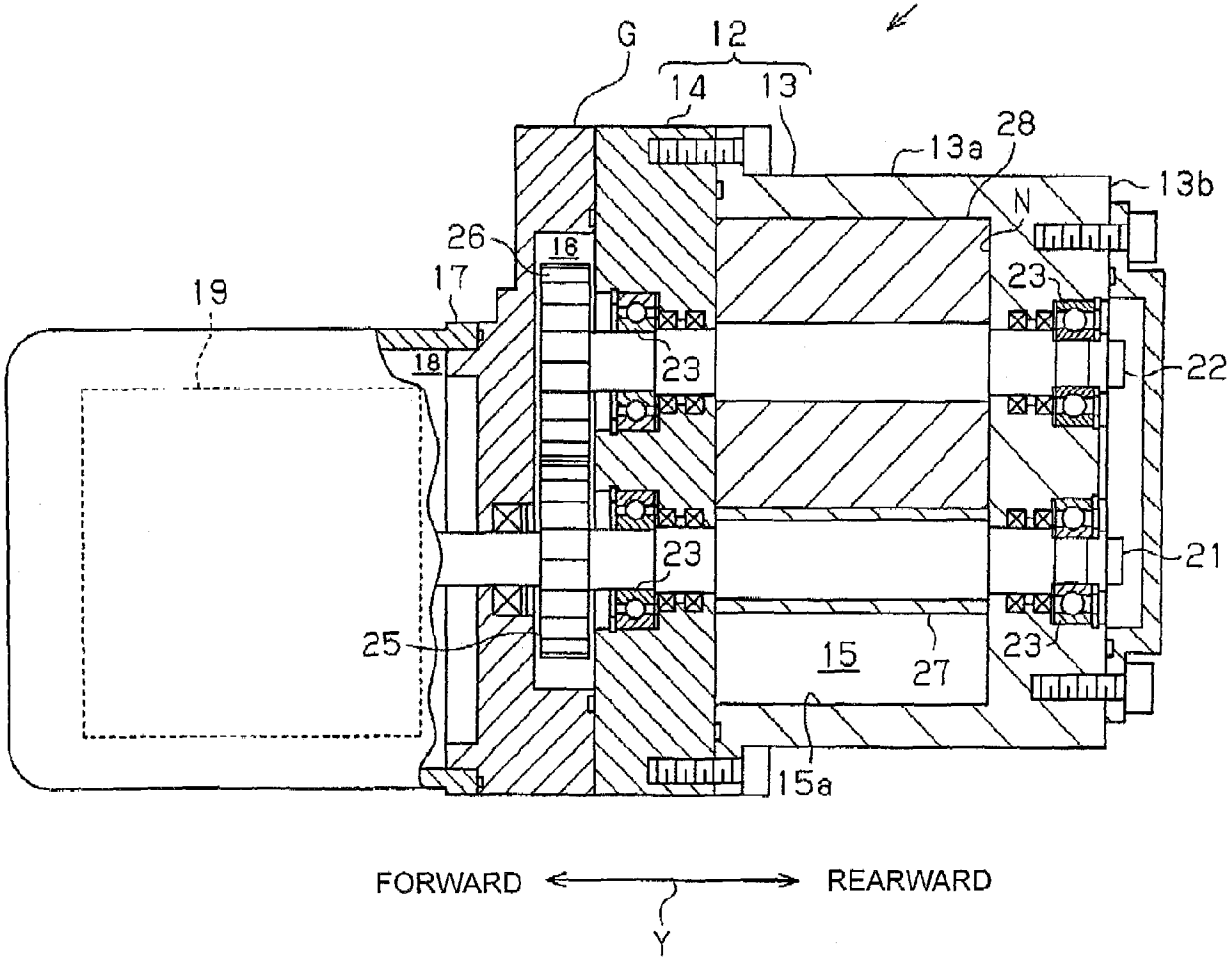
FIG. 1 is a horizontal sectional view showing a roots compressor according to first and second embodiments of the present invention.
Figure 2:
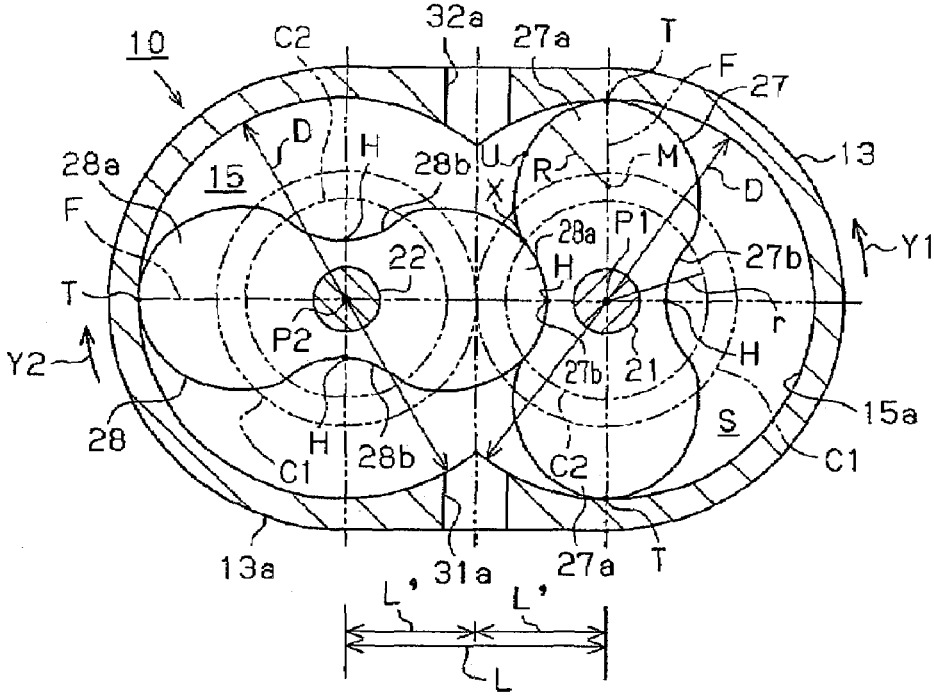
FIG. 2 is a cross sectional view showing two-lobe type drive and driven rotors of the roots compressor of FIG. 1 according to the first embodiment of the present invention.
Figure 3:
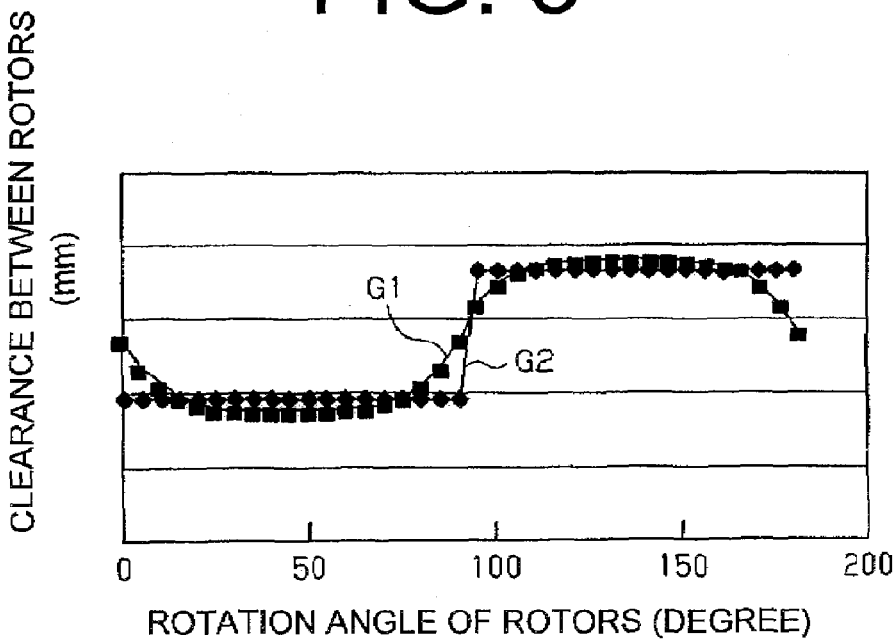
FIG. 3 is a graph showing a change of the clearance between the rotors upon occurrence of a phase shift of the rotors.

The following will describe the first embodiment of a roots type fluid machine of the present invention as embodied in a roots compressor with reference to FIGS. 1 through 3. It is noted that forward and rearward directions of the roots compressor are indicated by arrow Y of FIG. 1.

Referring to FIG. 1, the roots compressor 10 has a housing assembly (or a compressor housing) which includes a rotor housing 12, a gear housing G which is joined to the front end of the rotor housing 12, and a motor housing 17 which is joined to the front end of the gear housing G. The rotor housing 12 includes a first housing 13 and a second housing 14 which is joined to the front end of the first housing 13. The first housing 13 has a cylindrical shape having one end thereof closed, and has a cylindrical peripheral wall 13*a* and an end wall 13*b* which forms the bottom of the first housing 13.

The compressor housing has a rotor chamber 15 defined between the first housing 13 and the second housing 14, a gear chamber 16 between the second housing 14 and the gear housing G, and a motor chamber 18 between the gear housing G and the motor housing 17. In the motor chamber 18, is located an electric motor 19.

A drive shaft 21 extends rearward from the electric motor 19 in the compressor housing and serves as a rotary shaft. The drive shaft 21 is rotatably supported in the compressor housing by bearings 23 which are disposed in the end wall 13*b* of the first housing 13 and the second housing 14 of the rotor housing 12, respectively. In addition, a driven shaft 22 extends parallel to the drive shaft 21 and serves as a rotary shaft. The driven shaft 22 is rotatably supported in the compressor housing by bearings 23 which are disposed in the end wall 13*b* of the first housing 13 and the second housing 14 of the rotor housing 12, respectively. In the gear chamber 16, a drive gear 25 is fixed on the drive shaft 21 and a driven gear 26 is fixed on the driven shaft 22. The gears 25, 26 engage with each other and connect the drive shaft 21 and the driven shaft 22.

A drive rotor 27 that serves as a rotor is disposed or fixedly mounted on the drive shaft 21 in the rotor chamber 15. In addition, a driven rotor 28 that also serves as a rotor is disposed or fixedly mounted on the driven shaft 22 in the rotor chamber 15. As shown in FIG. 2, each of the drive and driven rotors 27, 28 is provided by a two-lobe rotor whose cross section taken perpendicular to the axis of the drive shaft 21 or the driven shaft 22 is of a two-lobe shape or a roughly figure "8" shape. The drive rotor 27 has two lobe portions 27*a* and two well portions 27*b* each formed between the two lobe portions 27*a*. Similarly, the driven rotor 28 has two lobe portions 28*a* and two well portions 28*b* each formed between the two lobe portions 28*a*.

The drive rotor 27 and the driven rotor 28 are located in the rotor chamber 15 so as to have a minimum clearance with respect to the peripheral surface 15*a* of the rotor chamber 15. That is, the apexes T of the lobe portions 27*a*, 28*a* extend along the axes of the drive and driven shafts 21, 22 and are prevented from being directly in slide contact with or directly interfering with the inner peripheral surface 15*a* of the rotor chamber 15 (or the inner peripheral surface of the peripheral wall 13*a*). In addition, the drive rotor 27 and the driven rotor 28 in engaging relation with each other have formed therebetween minimum clearance $\alpha$ for preventing them from directly interfering with each other. It is noted that bottom point H of each well portion 27*b* of the drive rotor 27 as shown in FIG. 2 divides the length of the well portion 27*b* along the peripheral direction of the drive rotor 27 into two equal parts, thus the point H being located at most inward position of the drive rotor 27. The same is true of bottom point H of each well portion 28*b* of the driven rotor 28 of FIG. 2.

The peripheral wall 13*a* of the first housing 13 has formed therethrough a suction port 31*a* for allowing fluid to be drawn therethrough into the rotor chamber 15 and a discharge port 32*a* for allowing compressed fluid to be discharged out of the rotor chamber 15. In operation of the above roots compressor 10 when the drive shaft 21 is rotated by the electric motor 19, the driven shaft 22 is rotated in counter direction to the drive shaft 21 by virtue of engaging relation between the drive gear 25 and the driven gear 26, and the drive rotor 27 and the driven rotor 28 are rotated, accordingly. The drive rotor 27 rotates in the direction indicated by arrow Y1 in FIG. 2 or in counterclockwise direction as seen in FIG. 2, and the driven rotor 28 rotates in the direction indicated by arrow Y2 or in clockwise direction. The drive and driven rotors 27, 28 of the roots compressor 10 are arranged such that one lobe portion 27*a* of the drive rotor 27 and one well portion 28*b* of the driven rotor 28 engage with each other and one lobe portion 28*a* of the driven rotor 28 and one well portion 27*b* of the drive rotor 27 engage with each other in accordance with the rotation of the drive rotor 27 and the driven rotor 28.

By rotation of the drive rotor 27 and the driven motor 28, the fluid is drawn into the rotor chamber 15 through the suction port 31*a*, and the fluid thus drawn into the rotor chamber 15 is trapped in the space S defined between the outer peripheral surface of the drive rotor 27 or the driven rotor 28 and the peripheral surface 15*a* of the rotor chamber 15. Subsequently, the fluid in the space S is transferred toward the discharge port 32*a* in accordance with the rotation of the drive rotor 27 and the driven motor 28, and then is discharged out of the rotor chamber 15 through the discharge port 32*a*.

The shape of the drive rotor 27 and the driven rotor 28 will now be described more in detail. Since the drive rotor 27 and the driven rotor 28 have substantially the same shape, the following will describe the shape of the drive rotor 27 only and omit the description of the shape of the driven rotor 28.

Referring to FIG. 2, the straight line which passes through central axis P1 of the drive shaft 21 and the apex T of the lobe portion 27*a* is referred to axis F of the drive rotor 27. The distance between the central axis P1 of the drive shaft 21 and central axis P2 of the driven shaft 22, or the distance between axes of the drive shaft 21 and the driven shaft 22 is denoted by L. Pitch circles C1 indicate two circles whose centers are located at the central axes P1 and P2, respectively, and in contact with each other at a point. Pitch radius L' of each pitch circle C1 is L/2. The shape of the drive rotor 27 between the apex T and the bottom point H will be described in detail, and the others similar to it will be omitted, since the drive rotor 27 is symmetric with respect to the axis F and the lobe portions 27*a* are symmetric with respect to the straight line which passes through the central axis P1 of the drive shaft 21 and the bottom point H of the well portion 27*b*.

The shape of the lobe portion 27*a* of the drive rotor 27 between the apex T and a point U along the circumferential or curved surface of the drive rotor 27 (or the circumferential direction of the drive shaft 21) is formed by a profile of a convex arc of a circle, whose center is on an imaginary point M located on the axis F and whose radius corresponds to distance R. That is, the tooth tip of the lobe portion 27*a* is formed by a profile of a convex arc of a circle whose radius is the distance R. It is noted that the above circle is a tip circle for the tooth tip of the lobe portion 27*a* of the drive rotor 27, and the distance R corresponds to the radius of the tip circle.

The shape of the drive rotor 27 between the point U and a point X along the curved surface of the drive rotor 27 is formed by an involute curve. This involute curve is based on a base circle C2 having its center at the central axis P1 of the drive shaft 21 and a radius corresponds to the distance r. The radius of the base circle C2 for the involute curve of the drive rotor 27, or a base radius corresponds to the above distance r.

In view of the distance L, the base radius r of the base circle C2 is set in the range below:

$$L/(2\sqrt{2})<r<0.3(\sqrt{2})L.$$

Also in view of the distance L, the radius R is set in the range below:

$$\{(\sqrt{2})/16\}\pi L<R<\{(27-5\sqrt{2})/56\}L.$$

In the tip circle of the lobe portion 27*a* of the drive rotor 27, the imaginary point M is set so that the tip circle is connected with the involute curve and also that the apex T forms minimum clearance with the inner peripheral surface 15*a* of the peripheral wall 13*a*, and the radius R is set in the above range. By setting the radius R of the tip circle and the base radius r of the base circle C2 in the above ranges, the shape of the well portion 27*b* of the drive rotor 27 between the point X and the bottom point H forms a profile of a concave arc which is an envelope of the convex arc of the tip circle with the radius R. The concave arc of the well portion 27*b* is formed so as to follow the outer shape or outer locus of the convex arc of the tip circle of the lobe portion 28*a* of the driven rotor 28, which engages with the drive rotor 27 when the rotor 28 is rotated. The drive rotor 27 has a configuration defined by a curve which includes the convex arc, the concave arc and the involute curve with the base radius r between the convex and concave arcs.

As the value of the base radius r for the involute curve approaches $L/(2\sqrt{2})$, the shape of the drive rotor 27 becomes closer to an involute type and relatively thin. As the value of the base radius r approaches $0.3(\sqrt{2})L$, on the other hand, the shape of the drive rotor 27 becomes closer to an envelope type and relatively thick. On the other hand, as the value of the radius R approaches $\{(\sqrt{2})/16\}\pi L$, the shape of the drive rotor 27 becomes closer to an involute type and relatively thin. As the value of the radius R approaches $\{(27-5\sqrt{2})/56\}L$, the shape of the drive rotor 27 becomes closer to an envelope type and relatively thick.

In the roots compressor 10 where the rotors 27, 28 are located in the rotor chamber 15, if any phase shift of the rotors 27, 28 occurs by an error during initial assembly of the drive rotor 27, the clearance formed between the rotors 27, 28 due to the phase shift is referred to as β. In this case, the clearance between the rotors 27, 28 varies repeatedly between the maximum value (α+β) and the minimum value (α−β) every 90-degree rotation of the rotors 27, 28.

Forming the well portions 27*b*, 28*b* engaging with the lobe portions 28*a*, 27*a* by an envelope, the clearance change between the value (α+β) and the value (α−β) takes place gradually even if the phase shift of the rotors 27, 28 occurs thereby to change the clearance between the maximum value (α+β) and the minimum value (α−β). FIG. 3 is a graph showing the clearance change between the rotors 27, 28 during the rotation of the rotors 27, 28 caused by the phase shift of the rotors 27, 28. Graph G1 shows the clearance change between the rotors 27, 28 of the present embodiment, and graph G2 shows the clearance change between involute type rotors of the prior art. The horizontal axis of the graph of FIG. 3 represents rotation angle (degree) of the rotors 27, 28, and the vertical axis represents the clearance change (millimeter) between the rotors 27, 28.

As shown in the graph G1 of FIG. 3, the clearance change at the position where the rotors 27, 28 engage with each other (or at 90-degree rotor angle) takes place gradually. In contrast, in the case of the involute type rotor of the prior art, the clearance change occurs rapidly at 90-degree rotor angle position as shown by graph G2.

According to the above first embodiment, the following advantageous effects are obtained.

(1) Each of the rotors 27, 28 has a configuration defined by a curve which includes the convex arc, the concave arc and further an involute curve with the base radius r between the convex and concave arcs. The base radius r for the involute curve is set in the range $L/(2\sqrt{2})<r<0.3(\sqrt{2})L$, and the radius R is set in the range $\{(\sqrt{2})/16\}\pi L<R<\{(27-5\sqrt{2})/56\}L$. By setting the base radius r and the radius R in the above ranges, the convex arc of the tip circle is continuous with the involute curve having the base radius r, and the envelope of the tip circle is formed in the well portions 27*b*, 28*b*.

Forming the well portions 27*b*, 28*b* engaging with the lobe portions 28*a*, 27*a* by an envelope, the clearance change between the rotors 27, 28 during the rotation of the rotors 27, 28 takes place gradually even if the phase shift of the rotors 27, 28 occurs. Therefore, even if the rotors 27, 28 interfere with each other when they engage with each other, the interference will not occur rapidly, so that the problems, such as the abnormal noise caused by the rapid interference and the poor performance of the compressor caused by rapid leakage of fluid can be prevented successfully. In addition, rapid vibration of the drive shaft 21 and the driven shaft 22 supporting the rotors 27, 28 is prevented, and the service life of the bearings 23 supporting the drive shaft 21 and the driven shaft 22 is prolonged, accordingly.

(2) The region of the rotors 27, 28 other than the tip circle and the envelope is formed by an involute curve. Therefore, compared to the envelope type rotor wherein the shape of the rotors 27, 28 is formed by an envelope, the above-described embodiment of the roots compressor 10 is advantageous in that the moment of inertia of the rotors 27, 28 is reduced and a larger volume of space is formed between the peripheral surface 15*a* of the rotor chamber 15 and the rotor 27 or 28. Consequently, displacement per rotation of the rotors 27, 28 is increased and the performance of the roots compressor 10 is enhanced, accordingly.

Figure 4:
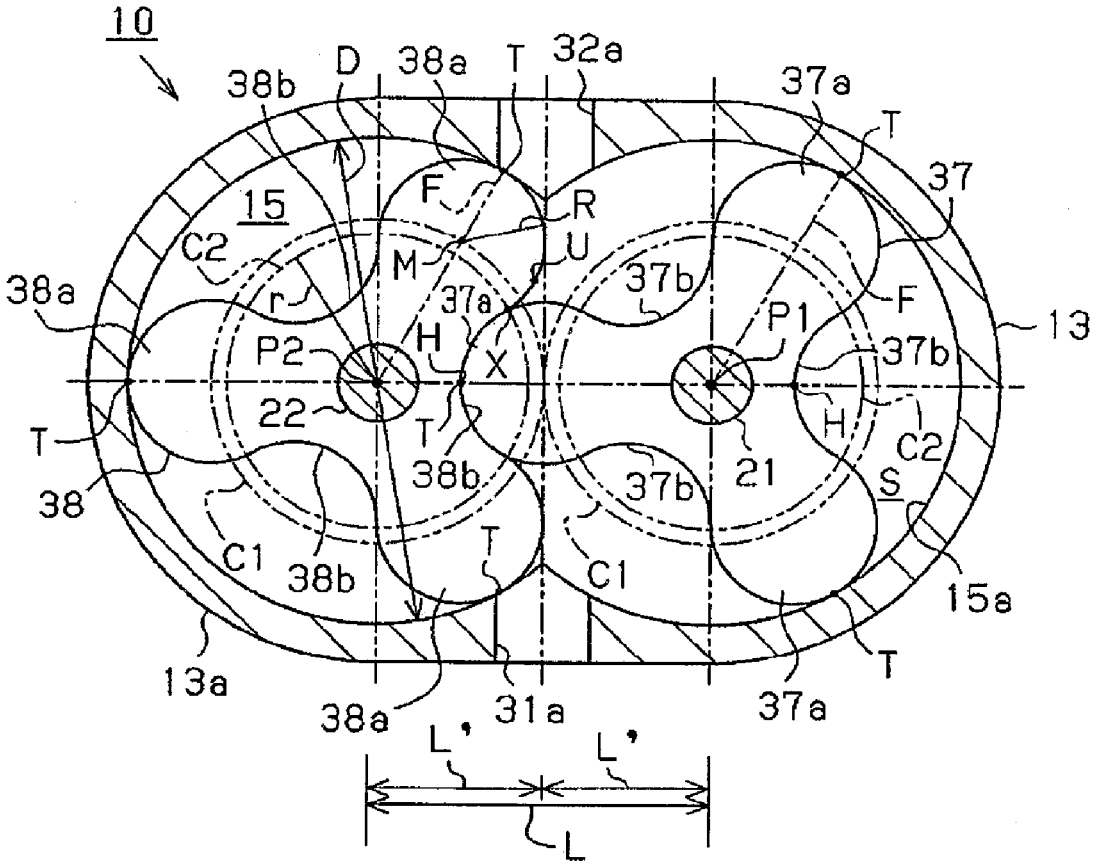
FIG. 4 is a cross sectional view showing three-lobe type drive and driven rotors of the roots compressor of FIG. 1 according to the second embodiment of the present invention.

The following will describe a second embodiment of a roots type fluid machine of the present invention as embodied in a roots compressor with reference to FIG. 4. In the following second embodiment, the same reference numerals and symbols as used in the description of the first embodiment are used and the description of the same parts and elements will be omitted or simplified.

A drive rotor 37 is disposed or fixedly mounted on the drive shaft 21 in the rotor chamber 15, and a driven rotor 38 is disposed or fixedly mounted on the driven shaft 22 in the rotor chamber 15. As shown in FIG. 4, each of the drive rotor 37 and the driven rotor 38 is a three-lobe rotor whose cross section taken perpendicular to the axis of the drive shaft 21 and the driven shaft 22 is of a three-lobe shape. The drive rotor 37 has three lobe portions 37*a* and three well portions 37*b* each of which is formed between any two adjacent lobe portions 37*a*. The driven rotor 38 has three lobe portions 38*a* and three well portions 38*b* which are formed and arranged in the same manner as those of the drive rotor 37.

The drive rotor 37 and the driven rotor 38 are located in the rotor chamber 15. The rotors 37, 38 have minimum clearance with the peripheral surface of the rotor chamber 15 for preventing the apexes T of the lobe portions 37*a*, 38*a* extending along the axial direction of the drive shaft 21 and the driven shaft 22 from being directly in slide contact with, or directly interfering with the peripheral surface 15*a* of the rotor chamber 15 (or the inner peripheral surface of the peripheral wall 13*a*). In addition, the rotors 37, 38 have minimum clearance $\alpha$ therebetween when they are engaged with each other for preventing them from directly interfering with each other.

The shape of the rotors 37, 38 will now be described in detail. Since the rotors 37, 38 have the same shape, the following will describe the shape of the driven rotor 38 only. As shown in FIG. 4, the straight line which passes through the central axis P2 of the driven shaft 22 and the apex T of the lobe portion 38*a* is referred to as the axis F of the lobe portion 38*a*. Since the driven rotor 38 has the same lobe shape every 120 degrees in the circumferential direction of the driven shaft 22, the shape of the driven rotor 38 will be described only with reference to the shape between the apex T and the bottom point H of the well portion 38*b*.

The shape of the lobe portion 38*a* of the driven rotor 38 between the apex T and the point U along the circumferential or curved surface of the driven rotor 38 (or the circumferential direction of the driven shaft 22) is formed by a profile of a convex arc of a circle whose center is positioned at the imaginary point M located on the axis F and whose radius corresponds to distance R. That is, the tooth tip of the lobe portion 38*a* is formed by a profile of the convex arc of the circle with radius R. It is noted that the above circle is a tip circle for the lobe portion 38*a* of the driven rotor 38 and the distance R is the radius of the tip circle.

The shape of the driven rotor 38 between the point U and the point X along the curved surface of the driven rotor 38 is formed by an involute curve. The base circle C2 of the involute curve has its center on the central axis P2 of the driven shaft 22 and a radius corresponds to the distance r. It is noted that the distance r is a base radius for the involute curve of the driven rotor 38.

In view of the distance L, the base radius r for the involute curve is set in the range as follows:

$$L/(2\sqrt{2})<r<1.35L.$$

Also in view of the distance L, the radius R is set in the range as follows:

$$\pi/(12\sqrt{2})L<R<0.25L.$$

In the tip circle of the lobe portion 38*a* of the driven rotor 38, the imaginary point M is set so that the tip circle is continuous with the involute curve, and also that the apex T forms minimum clearance with the inner peripheral surface 15*a* of the peripheral wall 13*a*, and the radius R is set in the above range. By setting the radius R of the tip circle and the base radius r in the above ranges, the shape of the well portion 38*b* of the driven rotor 38 between the point X and the bottom point H forms a profile of a concave arc which is an envelope of the convex arc of the tip circle with the radius R. The concave arc of the well portion 38*b* is formed so as to follow the outer locus of the convex arc of the tip circle of the lobe portion 37*a* of the drive rotor 37 engaging with the driven rotor 38 when the rotor 37 is rotated. The driven rotor 38 has a configuration defined by a curve which includes the convex arc, the concave arc and the involute curve with the base radius r between the convex and concave arcs.

Therefore, according to the second embodiment, the following effects are obtained in addition to the same effects as those which have been described under (1) and (2) of the first embodiment.

(3) Pulsation is reduced in the second embodiment, since the roots compressor 10 with the three-lobe type rotors 37, 38 has a space with a smaller volume between the peripheral surface 15*a* of the rotor chamber 15 and the rotor 37 or 38 as compared to the roots compressor with the two-lobe type rotors 27, 28. Since the number of the lobe portions and the well portions is larger than that of the lobe portions and the well portions of the first embodiment, the rotors 37, 38 tend to interfere with each other. Forming the well portions 37*b*, 38*b* engaging with the tip circle of the rotors 38, 37 by an envelope, however, the clearance change between the rotors 37, 38 during the rotation of the rotors 37, 38 is gradual, even if the rotors 37, 38 interfere with each other. Therefore, the problem associated with the rapid interference is prevented.

The above embodiments may be modified as follows.

The present invention is not limited to the roots compressor 10, but may be applied to a roots pump which transfers fluid.

Therefore, the present examples and embodiments are to be considered as illustrative and not restrictive, and the invention is not to be limited to the details given herein but may be modified within the scope of the appended claims.

What is claimed is:

1. A roots type fluid machine comprising:

a housing;

a pair of parallel rotary shafts rotatably supported by the housing;

a two-lobe rotor disposed on each rotary shaft in a rotor chamber of the housing so that the rotors engage with each other, each of the rotors comprising:

two lobe portions each having a profile of convex arc with a radius R; and two well portions each having a profile of concave arc which is an envelope of the convex arc of the lobe portion, wherein the rotor has a configuration defined by a curve which includes the convex arc, the concave arc and further an involute curve with a base radius r between the convex and concave arcs, wherein the base radius r is set in a range $L/(2\sqrt{2})<r<0.3(\sqrt{2})L$ where distance between axes of the rotary shafts is L, and the radius R is set in a range $\{(\sqrt{2})/16\}\pi L<R<\{(27-5\sqrt{2})/56\}L$.

2. The roots type fluid machine according to claim 1, wherein the rotary shafts include a drive shaft and a driven shaft, and the rotors include a drive rotor and a driven rotor.

3. The roots type fluid machine according to claim 1, wherein the rotors are fixedly mounted on the rotary shafts.

4. The roots type fluid machine according to claim 1, wherein the roots type fluid machine is a roots compressor.

5. A two-lobe rotor for use in a roots type fluid machine which includes a housing and a pair of parallel rotary shafts rotatably supported by the housing, the rotor being disposed on each rotary shaft in a rotor chamber of the housing so that the rotors engage with each other, each of the rotors comprising:

two lobe portions each having a profile of convex arc with a radius R; and two well portions each having a profile of concave arc which is an envelope of the convex arc of the lobe portion, wherein the rotor has a configuration defined by a curve which includes the convex arc, the concave arc and further an involute curve with a base radius r between the convex and concave arcs, wherein the base radius r is set in a range $L/(2\sqrt{2})<r<0.3(\sqrt{2})L$ where distance between axes of the rotary shafts is L, and the radius R is set in a range $\{(\sqrt{2})/16\}\pi L<R<\{(27-5\sqrt{2})/56\}L$.

6. A roots type fluid machine comprising:

a housing;

a pair of parallel rotary shafts rotatably supported by the housing;

a three-lobe rotor disposed on each rotary shaft in a rotor chamber of the housing so that the rotors engage with each other, each of the rotors comprising:

three lobe portions each having a profile of convex arc with a radius R; and three well portions each having a profile of concave arc which is an envelope of the convex arc of the lobe portion, wherein the rotor has a configuration defined by a curve which includes the convex arc, the concave arc and further an involute curve with a base radius r between the convex and concave arcs, wherein the base radius r is set in a range $L/(2\sqrt{2})<r<1.35L$ where distance between axes of the rotary shafts is L, and the radius R is set in a range $\pi/(12\sqrt{2})L<R<0.25L$.

7. The roots type fluid machine according to claim 6, wherein the rotary shafts include a drive shaft and a driven shaft, and the rotors include a drive rotor and a driven rotor.

8. The roots type fluid machine according to claim 6, wherein the rotors are fixedly mounted on the rotary shafts.

9. The roots type fluid machine according to claim 6, wherein the roots type fluid machine is a roots compressor.

10. A three-lobe rotor for use in a roots type fluid machine which includes a housing and a pair of parallel rotary shafts rotatably supported by the housing, the rotor being disposed on each rotary shaft in a rotor chamber of the housing so that the rotors engage with each other, each of the rotors comprising:

three lobe portions each having a profile of convex arc with a radius R; and three well portions each having a profile of concave arc which is an envelope of the convex arc of the lobe portion, wherein the rotor has a configuration defined by a curve which includes the convex arc, the concave arc and further an involute curve with a base radius r between the convex and concave arcs, wherein the base radius r is set in a range $L/(2\sqrt{2})<r<1.35L$ where distance between axes of the rotary shafts is L, and the radius R is set in a range $\pi/(12\sqrt{2})L<R<0.25L$.

* * * * *